United States Patent [19]

Rogers

[11] 4,379,034

[45] Apr. 5, 1983

[54] START-UP PROCEDURE FOR OXYGEN ELECTRODE

[75] Inventor: Douglas K. Rogers, Painesville, Ohio

[73] Assignee: Diamond Shamrock Corporation, Dallas, Tex.

[21] Appl. No.: 261,777

[22] Filed: May 8, 1981

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,403,083 | 9/1968 | Currey et al. | 204/98 |
| 3,527,690 | 9/1970 | Dubellay et al. | 204/284 |
| 3,985,631 | 10/1976 | Hora et al. | 604/429 |
| 4,135,995 | 1/1979 | Welch | 204/98 |
| 4,221,644 | 9/1980 | LaBarre | 204/98 |
| 4,312,720 | 1/1982 | LeFevre | 204/98 |

*Primary Examiner*—R. L. Andrews

*Attorney, Agent, or Firm*—Woodrow W. Ban

[57] ABSTRACT

This disclosure is directed to an oxygen (air) cathode start-up procedure capable of reducing operating voltage for such cathode without reducing useful electrode life by subjecting it to less (gauge) pressure than it will encounter during operation in conjunction with hot alkali, e.g., about 60° to about 85° C. for about 1 to about 24 hours. Preferably zero gauge pressure is used in conjunction with alkali at 60° to 80° C. for from 1 to 8 hours and a low current density of from about 30 to about 90 milliamperes/cm$^2$ is employed. Even more preferably, air or oxygen is supplied to such cathode at a flow rate from about 3 to about 10 times the stoichiometric rate required to conduct oxygen reduction. When air is used, preferably it is $CO_2$-free air.

5 Claims, 1 Drawing Figure

START-UP PROCEDURE FOR OXYGEN ELECTRODE

BACKGROUND OF THE INVENTION

In the field of electrochemistry there is a well-known electrochemical cell known as a chlor-alkali cell. In this cell, an electric current is passed through a saturated brine (sodium chloride salt) solution to produce chlorine gas and caustic soda (sodium hydroxide). A large portion of the chlorine and caustic soda for the chemical and plastics industries is produced in chloralkali cells.

Such cells are divided by a separator into anode and cathode compartments. The separator characteristically can be a substantially hydraulically impermeable membrane, e.g., a hydraulically impermeable cation exchange membrane, such as the commercially available NAFION manufactured by the E. I. du Pont de Nemours & Company. Alternatively, the separator can be a porous diaphragm, e.g., asbestos, which can be in the form of vacuum deposited fibers or asbestos paper sheet as are well known in the art. The anode can be a valve metal, e.g., titanium, provided with a precious metal coating to yield what is known in the art as a dimensionally stable anode.

One of the unwanted byproducts present in a chlor-alkali cell is hydrogen which forms at the cell cathode. This hydrogen increases the power requirement for the overall electrochemical process, and eliminating its formation is one of the desired results in chlor-alkali cell operation.

It has been estimated that 25 percent of the electrical energy required to operate a chlor-alkali cell is utilized due to the formation of hydrogen at the cathode. Hence, the prevention of hydrogen formation, e.g., by reacting hydrogen with oxygen at the cathode resulting in the formation of hydroxide, can lead to substantial savings in the cost of electricity required to operate the cell. In fairly recent attempts to achieve cost savings and energy savings in respect of operating chlor-alkali cells, attention has been directed to various forms of what are known as oxygen (air) cathodes. These cathodes prevent the formation of molecular hydrogen at the cathode and instead reduce oxygen to form hydroxyl ions. Savings in cost for electrical energy are thereby achieved.

One known form of oxygen (air) cathode involves use of an active layer containing porous active carbon particles whose activity in promoting the formation of hydroxide may or may not be catalyzed (enhanced) using precious metal catalysts, such as silver, platinum, etc. Unfortunately, however, the pores of such active carbon particles may become flooded with the caustic soda thereby significantly reducing their ability to catalyze the reduction of oxygen at the air cathode and resulting in decreased operating efficiency. In an attempt to overcome these difficulties in flooding of the active carbon, hydrophobic materials, e.g., polytetrafluoroethylene (PTFE), have been employed in particulate or fibrillated (greatly attenuated and elongated) form to impart hydrophobicity to the active carbon layer, per se, and/or to a protective (wetproofing) or backing sheet which can be laminated or otherwise attached to the active layer. Thus, PTFE has been employed in both active layers and in backing (wetproofing) layers secured thereto.

The present invention provides a process for starting up an oxygen (air) cathode, e.g., of the three-component variety, by what amounts to essentially zero pressure start-up using hot alkali, e.g., at 60° to 85° C. According to one preferred embodiment of this invention, low current density is used for the period of start-up, e.g., 30 to 90 milliamps/cm$^2$ for a sufficient period of time to accomplish start-up, viz., 1 to 24 hours. According to another preferred embodiment of this invention, the start-up is performed using a 3 to 10 times stoichiometric amount of air or oxygen required to conduct the oxygen reduction reaction desired in the electrolytic cell. Preferably $CO_2$-free air is used. Such excess of air is customarily employed in the process of this invention at 0 to 15 inches of water pressure.

U.S. Pat. No. 3,403,083 to Currey et al is directed to imposing decomposition voltage cross electrodes and recirculating the sodium chloride anolyte using greater brine feed rate than the amount which flows through the diaphragm. The temperature of the anolyte is controlled at between 75° to 80° C. versus the 65° C. normally used. The pH of the anolyte is controlled by the addition of acid to the system.

DuBellay et al, U.S. Pat. No. 3,527,690, is directed to a means for controlling and maintaining gas pressure within an oxygen depolarized cathode.

Hora et al, U.S. Pat. No. 3,985,631, discloses a pretreatment and startup of Nafion cell membranes involving immersion of the membrane and caustic while imposing a potential of from 6.5 to 8.5 volts followed by immediately passing a direct current therethrough and then regulating the voltage to maintain the desired current density.

Welch, U.S. Pat. No. 4,135,995, discloses using a cathode made of an intercalation compound of carbon and fluorine and were in the oxidant, e.g., air, is bubbled through the catholyte liquor, viz., added directly to the catholyte.

LaBarre, U.S. Pat. No. 4,221,644, is directed to operation of an oxygen (air) cathode with the stated objective of minimizing voltage necessary for operation by controlling the pressure of the air feed side to obtain positive gauge pressure, e.g., of 110 g/cm$^2$ (44 inches of water), for example, as stated in Example 1 with the stated range of pressure differential in the range of 0.25 through 500 g/cm$^2$ (0.1 to 200 inches of water); controlling the total flow of the air feed side; humidifying the air on the air feed side and elimination of $CO_2$ from the air feed.

At column 4, lines 9 to 14, LaBarre states that the air is fed to the interior of the oxygen compartment at a positive gauge pressure so as to accomplish a total flow rate in excess of the theoretical stoichiometric amount of oxygen necessary for the reaction.

In the first full paragraph of column 10 of LaBarre, viz., lines 9 to 20, LaBarre states that a pressure differential is applied across the porous cathode 18 so that the pressure in the oxygen compartment 24 is higher than that in the cathode compartment 22. The patentee further states that the increased pressure, which may be zero gauge to bubble through but due to the electrolyte head may be negative absolute, assists in mass transfer of the oxidizing gas such as air with $CO_2$ removed into the cathode 18 thereby preventing oxygen depletion in the reaction zone within the cathode 18 and leading to a longer cathode lifetime. The reference in LaBarre to the use of zero gauge to bubble through pressure is different from the start-up procedure of this invention in its use of the claimed range of reduced starting pressure, viz., from 0 to 306 mm Hg (0 to 27 inches of water) in at least the following respects: (1) The air flow rate in the LaBarre patent is set according to the desired excess air based on the final operating current density, e.g., 2.5 times the stoichiometric requirement of air at 310 $mA/CM^2$. In the procedure of this invention, it was found to be beneficial to cathode performance to start at an air flow rate in excess of that intended for normal operation and continue this "high" rate for the duration of the break-in period. Following the break-in, the air rate is decreased to preset levels. (2) Similarly, whereas this LaBarre patent sets the air pressure at that level planned for standard operation, the procedure of this invention prescribes that the pressure begin at zero and be increased to operating pressure only as break-in is concluded. In this manner, it is believed that the best surface area within the cathode can be wetted and maintained until operation is achieved, and the best voltage and life performance is yielded by the cathode so started.

DESCRIPTION OF THE DRAWING

The FIGURE is a cross-sectional view of an oxygen cathode type catalytic cell upon which the method of the invention may be practiced.

DETAILED DESCRIPTION OF THE INVENTION AND DRAWING

Figure 1:
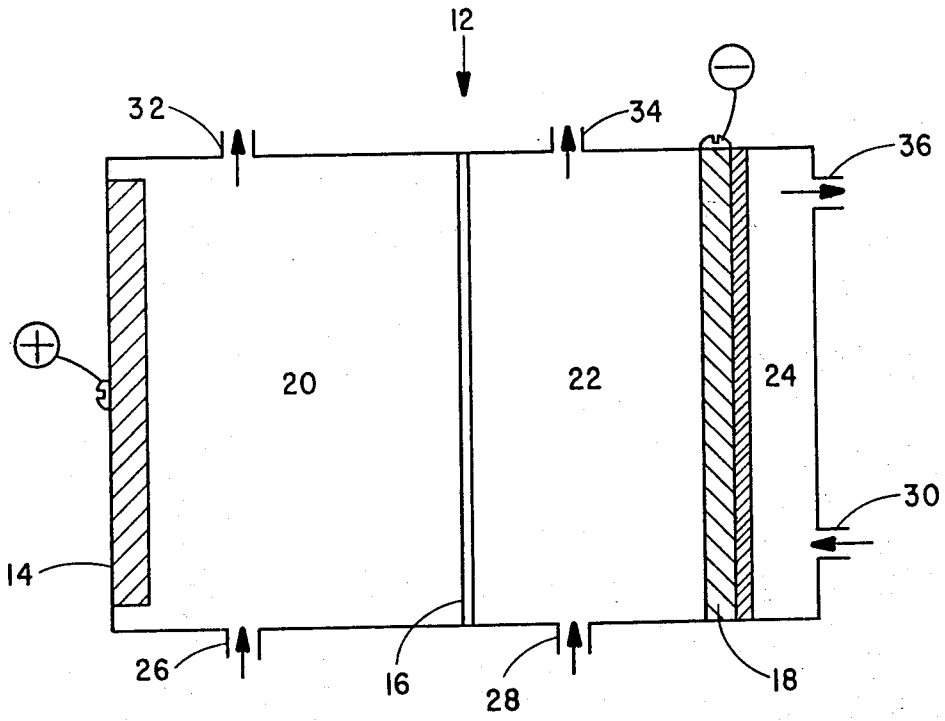

Basic Start-Up (Break-In) Parameters:

The process of this invention required (1) that the oxygen (air) electrode be subjected to less pressure at start-up than it will experience during operational use, and preferably to zero (0) gauge pressure, viz., 0 psig, in conjunction with (2) the use of hot alkali, viz., alkali metal hydroxide maintained at temperatures of about 60° to 85° C. for the entire duration of start-up, viz., time periods ranging from about 1 to about 24 hours. This invention is applicable to oxygen (air) cathodes which contain either active carbon or high surface area carbon, e.g., carbon block and enables reduction in operating voltage in conjunction with good overall performance characteristics.

According to one preferred embodiment, (3) the air or oxygen flow rate throughout start-up is established and maintained at a rate from about 3 to about 10 times the stoichiometric amount necessary to conduct the desired oxygen reduction reaction in the electrolytic cell. Preferably the $CO_2$ is removed from the air when air is used. In other words, this preferred embodiment mandates start-up at air (oxygen) flow rates exceeding those desired for use in operating such cell, and continuing such excessive oxygen (air) flow rates for the duration of the start-up period. Surprisingly, the use of flow rates of 3 to 10 times stoichiometric has been determined to be beneficial to later (operational) cathode performance. Prior to this invention, it was thought that start-up should mimic operating cell conditions.

According to another preferred embodiment of this invention, (4) lower current densities are used throughout start-up, e.g., about 30 to about 90 milliamps/$cm^2$, than are to be used during operation of the cell.

Basic Cell Components:

Referring to the sole FIGURE of the drawing, the monopolar electrolytic cell 12 is suitable to illustrate the start-up procedure of this invention. Of course, it should be understood that other designs and structural configurations could be employed for electrolytic cells which likewise could use the method of this invention to start-up gas electrodes, particularly those operating on oxygen or air. Cell 12 characteristically has some type of supporting structure or foundation to maintain it in correct alignment and is customarily arranged in a bank of such cells for production purposes. Such a supporting structure has not been shown. As will be noted from the drawing figure, anode 14 is located on one side of the cell and cathode 18 is located on the opposite side. Between the anode and cathode, there is located a separator 16 which can be of the diaphragm or membrane varieties, both of which are well-known in the art. On the one side of separator 16 is located the anode compartment 20 with its anolyte inlet 26 and a halogen outlet 32, which carries product chlorine in a chlor-alkali cell. On the other side of the separator is cathode compartment 22 with its water and catholyte inlet 28 and its alkali outlet 34, which carries out alkali metal hydroxide, e.g., sodium hydroxide in the case of a chlor-alkali cell. In the righthand portion of cathode compartment 22 is located oxygen (air) cathode 18 and its adjacent oxygen (air) compartment 24 having oxygen (air) inlet 30 and spent oxygen (air) outlet 36.

Cell 12 itself can be manufactured from various materials, either metallic or plastic in nature, as long as the cell material is capable of resisting the particular chemical environment in which it finds itself. Hence, the materials to fabricate the anode compartment must be resistant to chlorine in the case of a chlor-alkali cell. The materials from which the cathode compartment is fabricated must in turn resist alkali in a chlor-alkali cell. Such cells and the materials from which they are fabricated are well-known in the art and need not be discussed in detail herein.

Similarly, the anode 14 is characteristically constructed of a metallic material, although graphite carbon has been used in the older industrial electrodes. These anodes, particularly when used in a chlor-alkali cell, generally are made of anolyte-resistant active materials characterized in the art as valve metals. A preferred valve metal based upon cost, availability and electrical and chemical properties is titanium. The titanium anode can be fabricated in a variety of forms including, for example, expanded titanium metal mesh, solid metal sheet titanium, porous titanium produced by compacting titanium powder in a cold manner. A combination of the above forms of titanium can also be employed. The cell anode can be of the "dimensionally stable" type. Such dimensionally stable anodes are well-known and widely used in the electrochemical industry. The anode materials referred to in the LaBarre U.S. Pat. No. 4,221,644 are likewise suitable for use herein.

The same is true of the separator materials for separator 16 as contemplated in this invention. The materials disclosed in detail in U.S. Pat. No. 4,221,644 can be used for separator 16 herein whether the separator be of the diaphragm or membrane variety.

The present invention and its benefits are applicable to a wide variety of oxygen cathodes having an active layer, wetproofing layer and current distributor or collector.

The Electrodes Themselves:

In accordance with this invention, the oxygen (air) cathode can, but need not necessarily, be any one of those referred to in said LaBarre patent. Preferably, however, oxygen (air) cathode 18 is a three-component cathode which can be of the laminated type having a matrix active layer such as described and claimed in U.S. patent application Ser. No. 202,585, filed on Oct. 31, 1980, in the name of Frank Solomon and entitled "Three-layer Laminated Matrix Electrode," the disclosure of which is incorporated herein by reference. Such laminated matrix oxygen (air) cathodes can contain a porous polytetrafluoroethylene (PTFE) wetproofing layer laminated on one surface to a matrix active layer containing catalyzed or uncatalyzed active carbon particles present within an unsintered network of fibrillated carbon black/PTFE with an electroconductive current distributor laminated to the working surface of said active layer, viz., the surface in contact with the alkali.

Alternatively, the oxygen (air) cathode 18 can be a three-layer laminate containing the porous PTFE layer laminated to an active layer or sheet containing from about 60 to about 85 weight percent active carbon particles, the remainder being unsintered, fibrillated PTFE in intimate admixture with said active carbon and said active layer being laminated on its working surface to a current distributor. Such a laminated electrode is disclosed and claimed in Ser. No. 202,577 filed on Oct. 31, 1980, in the names of Frank Solomon and Charles Grun and entitled "Three-layer Laminate."

In addition to the foregoing laminated oxygen (air) cathodes, oxygen (air) cathode 18 can be of the type described and claimed in U.S. Pat. application Ser. No. 202,564 filed on Oct. 31, 1980, in the name of Frank Solomon and entitled "Non-bleeding Electrode" and comprised of a hydrophobic, PTFE-containing porous backing layer, an active layer containing high surface area carbon particles wherein the active layer has pores sufficiently large to relieve internal liquid pressures in the active layer and a current distributor. Usually when such an electrode is employed, the active layer is located between the backing layer and the current distributor, whether the assembly is consolidated by lamination, sintering, or lamination followed by sintering. The disclosures of these three patent applications Ser. Nos. 202,585, 202,577 and 202,564 are incorporated herein by reference.

Wetproofing Layer:

In accordance with one embodiment of this invention, the wetproofing layer of the three-component oxygen (air) cathode 18 is prepared as follows:

Two hundred cubic centimeters of isopropyl alcohol were poured into an "Osterizer" blender. Then 49 grams of duPont 6A polytetrafluoroethylene were placed in the blender and the PTFE—alcohol dispersion was blended at the "blend" position for approximately one minute. The resulting slurry had a thick pasty consistency. Then another 100 cc of isopropyl alcohol were added in the blender, and the mixture was blended (again at the "blend" position) for an additional two minutes.

Then 91 grams of particulate sodium carbonate in isopropanol (ball milled and having an average particle size of approximately 3.5 microns as measured by Fisher Sub Sieve Sizer) were added to the blender. This PTFE—sodium carbonate mixture was then blended at the "blend" position in the "Osterizer" blender for three minutes followed by a higher speed blending at the "liquefying" position for an additional one minute. The resulting PTFE—sodium carbonate slurry was then poured from the blender on to a Buchner funnel, filtered, and then placed in an oven at 80° C. where it was dried for three hours resulting in 136.2 grams yield of PTFE—sodium carbonate mixture. This mixture contained approximately 35 weight parts of PTFE and 65 weight parts of sodium carbonate.

This material was then fibrillated mildly in a Brabender Prep Center D101 for 15 minutes at 100 rpm and 20° C. using the Sigma Mixer Blade Model 02-09-000 as described above. The thus fibrillated mixture was then chopped for 5 to 10 seconds in a coffee blender (i.e., Type Varco, Inc. Model 228.1.000 made in France) to produce a fine powder.

The chopped, fibrillated mixture was then passed through six inch diameter rolls, heated to about 80° C. and using a roll gap typically 0.008 inch (8 mils). The sheets are formed directly in one pass and are ready for use as backing layers in forming electrodes, e.g., oxygen cathodes, with no further processing beyond cutting, trimming to size and the like.

The thus formed backing layer (after removal of the pore-forming agent) is characterized as porous, self-sustaining, coherent, unsintered uniaxially oriented backing (wetproofing) layers of fibrillated polytetrafluoroethylene having pore openings of about 0.1 to 40 microns (depending on the size of the pore former used and exhibit air permeability particularly well suited for oxygen (air) cathodes).

Active Layer(s):

The start-up procedure of this invention is applicable to a wide variety of oxygen cathodes, including those wherein the oxygen (air) cathode 18 has a matrix active layer, viz., an active layer comprising active carbon particles (catalyzed or uncatalyzed) present within an unsintered network or matrix of fibrillated carbon black/polytetrafluoroethylene. Such matrix active layers can contain silver catalyzed active carbon particles, platinum catalyzed active carbon particles or simply activated carbon particles without any additional catalyst or enhancer thereon or therein.

A matrix active layer containing silver catalyzed active carbon particles can be prepared as follows:

Commercially available ball milled "RB carbon" was found to have an ash content of approximately 12 percent as received. This "RB carbon" was treated in 38 percent KOH for 16 hours at 115° C. and found to contain 5.6 percent ash content after a subsequent furnace operation. The alkali treated "RB carbon" was then treated (immersed) for 16 hours at room temperature in 1:1 aqueous hydrochloric acid (20 percent concentration). The resulting ash content had been reduced to 2.8 percent. "RB carbon," deashed as above, was silvered in accordance with the following procedure:

Twenty (20 g) grams of deashed "RB carbon" were soaked in 500 ml of 0.161 N (normal) aqueous $AgNO_3$ with stirring for two hours. The excess solution was filtered off to obtain a filter cake. The retrieved filtrate was 460 ml of 0.123 N $AgNO_3$. The filter cake was rapidly stirred into an 85° C. alkaline formaldehyde solution, prepared using 300 cc (cubic centimeters) water, and 30 cc of 30 percent aqueous NaOH and 22 cc of 37 percent aqueous $CH_2O$, to ppt. Ag in the pores of the active carbon.

Calculation indicated that 79 percent of the 2.58 grams of retained silver in the catalyst was derived from adsorbed silver nitrate.

Separately, "Shawinigan Black," a commercially available actylene carbon black, was teflonated with "Teflon 30" (duPont polytetrafluoroethylene dispersion) using an ultrasonic generator to obtain intimate mixture. 7.2 grams of the carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of a 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a boiling mill. The resulting matrix active layer sheet had an area density of 22.5 $m/cm^2$ and was ready for lamination.

A matrix active layer containing platinum catalyzed active carbon particles can be prepared by the procedure set forth above for silver catalyzed active carbon particles except that platinum was deposited on the described active ("RB") carbon instead of silver. The 10 to 20 micron classified deashed "RB" carbon had platinum applied thereto in accordance with the procedure described in U.S. Pat. No. 4,044,193 using $H_3Pt(SO_3)_2OH$ to deposit one weight part platinum per 34 weight parts of deashed active carbon. After fibrillation and upon rolling, the area density of this active layer was determined to be 22.2 milligrams per centimeter square. This matrix active layer was then ready for lamination to a current distributor and a wetproofing layer containing PTFE prepared as described herein.

Current Distributor:

The current distributor layer, which is usually positioned next to and laminated to the working surface of the active layer of the three-layer laminate, can be an asymmetric woven wire mesh wherein the material from which the wire is made is selected from the group consisting of nickel, nickel-plated copper, nickel-plated iron, silver-plated nickel, and silver-plated, nickel-plated copper and like materials. In such asymmetric woven wire mesh current distributors, there are more wires in one direction than in the other direction.

The current distributor or collector can be a woven or nonwoven, symmetrical or asymmetric wire mesh or grid. Generally, there is a preferred current carrying direction. When the current distributor is a woven wire mesh, there should be as few wires as feasible in the noncurrent carrying direction. There will be found to be a minimum required for fabrication of a stable wire cloth. A satisfactory asymmetric wire cloth configuration may consist of, e.g., 50 wires/inch in the warp direction but only 25 wires per inch in the fill, thus maximizing the economy and utility of the wire cloth, simultaneously.

These asymmetric woven wire current distributors referred to hereinabove are described and claimed in U.S. patent application Ser. No. 202,574 filed in the name of Frank Solomon on Oct. 31, 1980, and entitled "Asymmetric Current Distributor," the disclosure of which is incorporated herein by reference. Such asymmetric woven wire mesh current distributors are useful as the current distributor in the three-layer laminates of this invention which are useful as oxygen cathodes in chlor-alkali cells.

Alternatively, the current distributor can be of the porous plaque type, viz., a comparatively compact yet porous layer, having porosities ranging from about 30 to about 80 percent and made of powders of Ni, Ag or the like.

Such three-layer laminates usually have the active layer centrally located, viz., positioned in the middle between the backing layer on the one side and the current distributor (collector) layer on the other side. The three layers arranged as described are laminated using heat and pressure at temperatures ranging from about 100° to about 130° C. and pressures of 0.5 to 10 $T/in^2$ followed by removal from the pressing device. The laminates can then be subjected to a hot soaking step in ethylene glycol or equivalent polyol to enhance removal of the pore-forming agent(s) employed to form the aforementioned backing (wetproofing) layer and any bulking and/or forming pore agent optionally included in the active layer upon subsequent washing(s) with water.

The PTFE porous wetproofing layer prepared as described above can be laminated with an active layer of the matrix type also prepared as described above to a current distributor having a diameter of 0.005 inch nickel woven wire mesh with a 0.0003 inch thick silver plating and a woven strand arrangement of $50\times50\times0.005$. The distributor is positioned on one active layer side while the backing layer is placed on the other side of the active layer. The lamination is performed in a hydraulic press at 100° to 130° C. using pressures of 4 to 8.5 $T/in^2$ for several minutes. The laminate is then hot soaked in ethylene glycol at 75° C. for 20 minutes before water washing at 65° C. for 18 hours. The laminate is then dried. Such laminates are then ready for testing according to the start-up procedure of this invention as will be discussed in greater detail hereinafter.

Oxygen Cathode Variations:

The three-layer laminated oxygen (air) cathode 18 can include a PTFE-containing wetproofing layer prepared as described above with an active layer containing from about 60 to about 85 weight percent active carbon, the remainder being unsintered, fibrillated PTFE in intimate admixture with said active carbon, and laminated to a current distributor of the type indicated hereinabove. Said active layer can be prepared by the following procedure:

100 grams of RB active carbon were ball milled for 4 hours in water. This carbon was subsequently treated with 1600 ml or 38 percent NaOH for an hour at 110° to 120° C. with stirring. It was then filtered and washed. This treatment was repeated three times, then followed by a room temperature overnight soak in 1:1 HCl and a final washing and drying in air at 110° C. to result in deashed RB carbon, viz., referred to herein as RBDA.

20 g of carbon, so prepared, were then platinized in a ratio of 28 parts of carbon to one part Pt, using $H_3Pt(SO_3)_2OH$ in accordance with the procedure of U.S. Pat. No. 4,044,193. Twenty (20) grams of carbon were suspended in 333 ml of water and 357 ml of $H_3Pt(SO_3)_2OH$ (200 g Pt/liter solution) were added and then decomposed to hydrous platinum oxide by the addition of 8.6 ml of 35 percent $H_2O_2$. After filtering, washing and air drying at 140° C., the catalyzed carbon was ready for the next step, "Teflonation."

20 g of catalyzed carbon were suspended in 300 ml water with stirring. 8.4 ml of "Teflon 30" dispersion were separately diluted in 300 ml of water. The diluted Teflon 30 dispersion was slowly added to the catalyzed carbon suspension. After coagulation, the mixture was washed and dried.

The mix was weighed and was found to be 25 g. The 25 g mix was then fibrillated (fiberized) by shear blending in the Brabender Prep Center, in measuring head type REO-6 using medium shear cams or blades. The mix was lubricated with 38 cc of 30 percent isopropanol in water and was kneaded for 2½ minutes at 25 rpm. It was then vacuum dried. 3 g of mix were chopped 30 seconds in a Varco Mod. 228-1 coffee grinder and then rolled at 75° C. through 6 inch diameter rolls at a roll separation of 0.007 inch. The rolled sheet was 0.010 inch thick. At this point, the sheet was ready for incorporation into an electrode.

The three layers, viz., the PTFE containing layer, the active layer and the current distributor were arranged to have the active layer centrally located, viz., positioned in the middle between the backing layer on the one side and the current distributor on the other side. These three layers were laminated using heat and pressure at temperatures ranging from about 100° to about 130° C. and pressures of 0.5 to 10 T/in$^2$ followed by removal from the pressing device. The laminate was then subjected to a hot soaking step in ethylene glycol or equivalent polyol to enhance removal of the pore-forming agent(s) employed to form the aforementioned backing layer and any bulking and/or pore-forming agent optionally included in the active layer, upon subsequent washing(s) with water. These laminates were then subjected to the start-up procedure of this invention as will be indicated in more detail hereinbelow.

The oxygen (air) cathodes 18 can contain the PTFE-containing wetproofing layer preferred as described above along with the active layer described in the non-bleeding electrode of Ser. No. 202,564 mentioned above. In order to form such active layers, the porous carbon particles are combined with a hydrophobic agent, preferably polytetrafluoroethylene (PTFE) in aqueous dispersion form. The particulate PTFE can have individual particle sizes ranging from about 0.05 to about 0.5 microns. It will be observed that the particle size of the PTFE particles is significantly smaller than that of porous active carbon particles but larger than that of porous high surface area carbon black particles. The carbon black or active carbon particles are combined intimately with the PTFE particles in a procedure referred to as "Teflonating."

In combining porous, high surface area carbon particles with the PTFE particles, more high surface area carbon is used than PTFE. Thus the concentration of PTFE in the carbon/PTFE mix ranges from about 10 to 40 weight parts of PTFE and from about 60 to 90 weight parts of high surface area carbon to make up 100 weight parts of mix upon drying. More usually, however, the concentration of PTFE ranges from about 20 to 35 weight parts per 100 weight parts of dried mix with the remaining about 65 to about 80 weight parts being high surface area carbon particles. A mix of 65 weight parts of carbon black is combined with 35 weight parts of PTFE present in an aqueous dispersion known as "duPont TFE 30" dispersion by first placing the carbon black in isopropyl alcohol and then gradually adding the aqueous dispersion of PTFE particles to "Teflonate" the carbon black. Subsequently the "Teflonated" carbon black is dried to remove substantially all of the water therefrom and then redispersed in a lower alkyl alcohol, such as isopropanol. A pore-forming agent is added to the alcohol dispersion.

Pore Formers:

Electrodes subjected to the start-up procedure of this invention can contain a pore former incorporated in intimate mixture with the high surface area carbon/PTFE in the active layer of the electrode. In order to accomplish this, either a volatile fugitive pore former or a soluble fugitive pore former can be employed, viz., one capable of removal by heating or one capable of being dissolved out of the electrode. A variety of volatile and soluble pore-forming agents can be used. Where it is desired to use a volatile, pore-forming agent, ammonium benzoate, can be used. Soluble pore formers such as the water-soluble sodium carbonate are also suitable for use in this invention.

The procedure of incorporating the pore former will be described below in conjunction with carbon black, but it will be realized that a similar procedure can be used for active carbon. The pore former is combined with the high surface area carbon black/PTFE mix using from about 20 to about 80 weight parts of pore former and correspondingly from about 80 to about 20 weight parts of high surface area carbon/PTFE mix to achieve 100 weight parts of said mix including pore former. Usually, however, the concentration of pore former per 100 parts of mix plus pore former ranges from about 20 to about 60 weight parts.

The pore former, whose particle size can range from 1 to about 30 microns, in alcohol is added gradually to the alcohol dispersion of "Teflonated" high surface area carbon black particles usually at ambient room temperatures, viz., about 15° to 25° C. for time periods sufficient to uniformly incorporate the pore former in the mix. The "wet" mix of pore former plus high surface area carbon black/PTFE is then ready for final processing to form the active layer or sheet.

The active layer or sheet can be formed by removing the alcohol from the wet mix followed by drying it and then passing the dried mix through the nip of heated rollers usually heated to temperatures of 80° to 100° C. using nip gaps of 5 to 20 mils. In accordance with another embodiment of this invention, the active layer can be formed on a filter paper media substrate to which has been applied a release layer of salt, viz., sodium chloride. Sufficient pore former high surface carbon black/PTFE mix is deposited onto the salt-coated filter paper substrate to achieve active layer thicknesses ranging from about 5 to about 25 mils.

Catalysts:

When catalyzed carbon black particles in the active layer, the precious metal catalyst can be deposited on and/or within the high surface area carbon black particles, per se, usually prior to "Teflonation" thereof and prior to admixture with the pore-forming agent. Alternatively, the precious metal catalyst can be deposited on the formed active layer prior to combining with the backing layer and current distributor and sintering of the same.

Discrete, high surface area carbon black particles can be precatalyzed, viz., have a precious metal catalyst, e.g., Pt, deposited thereon prior to "Teflonation" and combining with the pore former. In accordance with such procedure, the platinum catalyst is derived from $H_3Pt(SO_3)_2OH$ by the procedure set forth in U.S. Pat. No. 4,044,193. This platinum precursor is then reduced to metallic platinum with the use of heat, or it can be done at ambient room temperatures using a reducing agent. After catalyzing, the high surface area carbon black particles are filtered and vacuumed-dried in preparation for "Teflonation" in the manner already described. Alternatively, a chloroplatinic acid platinum precursor can be employed to "precatalyze" the carbon black followed by chemical reduction using sodium borohydride or formaldehyde as the reducing agent.

Instead of precatalyzing, the catalyst can be applied to the carbon after formation of the active layer or sheet. This procedure is referred to as "post catalyzing" which in the case of deposition of a platinum catalyst is referred to as "post platinizing." The post platinizing can be performed in accordance with the procedure described and claimed in U.S. patent application Ser. No. 202,572 filed on Oct. 31, 1980, in the name of Lawrence J. Gestaut and entitled "Post Platinizing High Surface Carbon Black." The disclosure of this application is incorporated herein by reference. Essentially this procedure involves placing the previously formed active layer sheet on a source of heat, e.g., a hot substrate, and applying thereto an alcohol solution of chloroplatinic acid containing about 0.1 ml of solution per $cm^2$ of active layer surface to be catalyzed while keeping said active layer surface hot and maintaining the temperature of the substrate at approximately 400° F. while the alcohol solution of chloroplatinic acid is deposited thereon, e.g., by brushing, spraying, etc. In such a "post platinizing" procedure, it is observed that the solvent virtually flashes off during application. This procedure is continued to deposit from 0.025 to about 0.75 mg of platinum per $cm^2$ of active layer surface. Deposition of the chloroplatinic acid or equivalent Pt precursor at these temperatures effects an initial reduction thereof to Pt which reduction is completed using, e.g., alkaline sodium borohydride. Alternatively the platinization can be performed while the active layer is still on the salt-coated filter paper by placing the salt paper with the active layer thereon on the hot plate and brushing the active layer side with the platinum coating solution. Alternatively the electrode can be laminated and then platinized prior to sintering same. The "post platinizing" procedure described herein permits obtaining very low loadings of platinum, e.g., from about 50 to about 100 micrograms of platinum per $cm^2$ of catalyzed active layer surface.

Of course, other precious metal catalysts can be used to enhance the catalytic activity of the high surface area carbon black contained in the active layer of the electrodes of this invention. Thus silver can be deposited on and/or within the high surface area carbon black particles, e.g., using a silver nitrate precursor solution followed by removal of excess silver nitrate solution and chemical reduction with alkaline formaldehyde solution.

In forming the electrodes, "Teflonated," high surface area carbon black can be heated before combining with the pore former to remove the bulk of the wetting agent employed to form the initial PTFE aqueous dispersion used for "Teflonation." This heating step can be conducted in air at temperatures ranging from about 250° to 325° C., more usually from about 275° to 300° C. for from 10 minutes to 1½ hours and more preferably from 20 minutes to 60 minutes. Alternatively the PTFE wetting agent can be removed by extracting it using chloroform ($CHCl_3$) in a Soxhlet extractor for 8 to 16 hours. Such procedure is described and claimed in U.S. patent application Ser. No. 202,584 filed in the name of Frank Solomon on Oct. 31, 1980, and entitled "Extraction Treatment."

The electrodes can be formed by either laminating, sintering under pressure or laminating followed by sintering. For example, these three-layer electrodes can be formed by placing the active layer, as described above, centrally located, viz., between the PTFE-containing backing layer on the one side and the current distributor layer on the other side. These three layers arranged as described above can be laminated utilizing temperatures of about 200° to 400° F. (93° to 205° C.) and pressures of from 0.5 to 10 $T/in^2$ to effect consolidation of the three layers. Alternatively the three-layer assembly can be subjected to temperatures sufficient to effect sintering of the PTFE. Sintering temperatures can range from about 275° to 370° C. and more usually temperatures of about 340° to about 370° C. The sintering can be performed in conjunction with the use of pressures ranging from about 0.5 to 10 $T/in^2$ followed by removal from the pressing device. Also the assembly can be laminated as described to initially consolidate it followed by sintering with or without pressure.

When manufacturing laminated oxygen (air) electrodes, the laminating can take place prior to removal of the pore former from the active layer and backing layers of the electrode precursor to achieve the pore structure in the active layer of the electrode. The expression "electrode precursor" as used herein denotes the electrode which still contains the pore former which is to be removed prior to use. The specific manner of removing the pore former will depend upon what type of pore-forming agent has been used. Thus if a souble, viz., preferably water-soluble, pore-forming agent such as sodium carbonate has been used, it can be removed by one or more washings using water, preferably warm water at temperatures of 50° to 80° C.

Oxygen (air) electrodes, started in accordance with this invention, described and claimed in U.S. patent application Ser. No. 202,573 filed in the name of Frank Solomon on Oct. 31, 1980, and entitled "Electrode Layer Treating Process," wherein a sintered electrode is subjected to one or more hot soaks in an alkylene polyol, e.g., ethylene glycol, at temperatures of 50° to 100° C. before washing in water. This hot soak enhances the resistance of the formed electrode to blistering during subsequent water washings, which are employed to remove most of the soluble pore-forming agent.

The present invention will be illustrated in further detail in the examples which follow in which all parts, percents and ratios are by weight unless otherwise indicated.

EXAMPLE 1

A one square inch test cathode was cut from a larger laminated sheet prepared, for start-up according to this invention as follows:

A porous, self-sustaining, coherent, unsintered, polyaxially oriented wetproofing layer of fibrillated PTFE was formed to contain 65 percent of ball milled $NaHCO_3$ pore former and 35 percent PTFE (as an aqueous dispersion of PTFE coagulum, viz., duPont PTFE 42, coagulated into a floc by addition of isopropyl alcohol) by Sigma mixing same, chopping and rolling into sheet form by passing it several times through rollers, with folding and change of direction on each pass to result in a polyaxially oriented sheet. This sheet was then degreased, viz., the oil was extracted with "M-Clere D" (a commercial solvent) and heated at 300° C. for 20 minutes to prepare it for assembly.

An active layer of "Teflonated," fiberized, platinized, RB DA active carbon (RB carbon previously deashed by alkali then acid treatment as described above) was prepared to contain 61.1 percent RBDA; 18.5 percent platinum and 20.4 percent PTFE ("Teflon 30"). The RBDA carbon was platinized by soaking it in chloroplatinic acid and precipitating the Pt metal using potassium borohydride. Then the platinized RBDA was "Teflonated" fiberized (fibrillated and rolled into sheet form as described hereinabove.

This active layer was then assembled as the central layer with the PTFE wetproofing layer on one side and a current distributor on the other side. The current distributor was a 30×30 mesh of 0.006 inch diameter nickel wire having a 0.0003 inch thick plating of siver. The assembly was pressed at 8.5 tons/in$^2$ and 115° C. for 3 minutes to yield the laminated cathode.

This cathode was started up with an air feed rate of 90 cc/min at zero gauge pressure in a cell with about 100 mm Hg head of 8 molar NaOH electrolyte at 80° C. Current density was 310 mA/cm$^2$ and initial voltage was −302 mV vs Hg/HgO reference in the same electrolyte. After one hour of these starting conditions, the cathode voltage had "increased" to −383 mV. At this point, the pressure was increased for the air feed. The stoichiometric air flow rate was maintained so there was no change in the amount of air on a mole basis but the pressure increased. At the one hour mark at 806 mm Hg pressure, the cathode potential was −330 mV and decreased with increasing pressure according to the following seen data.

| Gauge Air Pressure at Set Flow (mm Hg) | (psig) | Cathode Voltage (mV vs. Hg/HgO) |
|---|---|---|
| 0 | 0 | −383 |
| 45.6 | approx. 1 | −330 |
| 98.8 | 2 | −318 |
| 152.0 | 3 | −308 |
| 205.2 | 4 | −294 |
| 258.4 | 5 | −280 |
| 304.0 | 6 | −270 |
| 357.2 | 7 | −264 |
| 410.4 | 8 | −259 |

This same cathode sheet had demonstrated a voltage of −455 mV when started in the exact same manner except at 1 psig pressure. Starting at zero psig, then, showed a 125 mV improvement over starting at 1 psig (which was the operating pressure of that run).

EXAMPLE 2

A one square inch test cathode was cut from a larger laminated sheet prepared using a wetproofing layer and current distributor as in Example 1 but with an active layer containing 73.5 percent RBDA carbon, 2.0 percent platinum (applied by the method set forth in U.S. Pat. No. 4,044,193 and 24.5 percent PTFE. After platinizing, the RBDA particles were "Teflonated," fiberized, rolled into sheet form and laminated as in Example 1.

This cathode was started up according to the zero pressure hot alkali procedure described in Example 1 with an initial voltage of −218 mV vs. Hg/HgO. After one hour of starting condition, the following scan was taken.

| Gauge Air Pressure (mm Hg) | Cathode Potential (mV vs. Hg/Hg) |
|---|---|
| 0 | −196 |
| 205.2 | −180 |
| 258.4 | −182 |
| 304.0 | −165 |
| 357.2 | −160 |
| 410.4 | −154 |
| 463.6 | −149 |

The cathode operated in a stable manner for another two weeks before the test was terminated by an air feed interruption. Voltage for this period average approximately −260 mV at zero pressure.

EXAMPLE 3

A one square inch test cathode was prepared as in Example 2 and zero pressure hot alkali start-up was performed on this cathode. After start-up for an hour, the air pressure was increased to 254 mm of water column at the same flow rate of 2.5 times the stoichiometric air requirement. At 85° C., 8 to 9 molar caustic was the electrolyte. Stable performance of around −410 mV vs. Hg/HgO was seen for 29 days prior to accidental failure.

EXAMPLE 4

A cathode from the same sheet as that of Example 3 was tested under the same conditions as in Example 3 and showed stable performance for over 50 days before accidental failure. Cathode potential averaged −500 mV vs. Hg/HgO under the same condition and start-up described above in Example 3.

I claim:

1. A start-up procedure for an alkali metal halide electrolyzing cell having an oxygen cathode comprising subjecting said cathode to a positive gauge pressure but a lesser gauge pressure than it will encounter during operation and contacting the cathode with an alkali metal hydroxide at temperatures ranging from about 60° to 85° for from about 1 to about 24 hours prior to operational use.

2. A start-up procedure as in claim 1 wherein said start-up pressure is zero gauge.

3. A start-up procedure as in claim 1 wherein said cathode is subjected to a current density of about 30 to about 90 milliamperes/cm$^2$ for said time period.

4. A start-up procedure as in claim 3 wherein air or oxygen is supplied to said cathode at a flow rate of from about 3 to about 10 times the stoichiometric amount of air required to conduct the oxygen reduction reaction during operational use is supplied to said cathode during said time period.

5. A start-up procedure as in claim 4 wherein said air is $CO_2$-free air.

* * * * *